US010266357B2

(12) United States Patent
Hashimoto et al.

(10) Patent No.: US 10,266,357 B2
(45) **Date of Patent: *Apr. 23, 2019**

(54) SHEET CONVEYING DEVICE AND IMAGE FORMING APPARATUS

(71) Applicant: Brother Kogyo Kabushiki Kaisha, Nagoya-shi, Aichi-ken (JP)

(72) Inventors: Yohei Hashimoto, Nagakute (JP); Hirotaka Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/892,066

(22) Filed: Feb. 8, 2018

(65) Prior Publication Data

US 2018/0237244 A1 Aug. 23, 2018

(30) Foreign Application Priority Data

Feb. 23, 2017 (JP) ..... 2017-032233

(51) Int. Cl.
*B65H 7/02* (2006.01)
*B65H 5/06* (2006.01)
(Continued)

(52) U.S. Cl.
CPC ..... *B65H 7/02* (2013.01); *B65H 5/06* (2013.01); *G03G 15/6508* (2013.01);
(Continued)

(58) Field of Classification Search
CPC ..... B65H 2553/20; B65H 2553/232; B65H 7/02; B65H 2553/612; B65H 2553/25; B65H 2553/81
See application file for complete search history.

(56) References Cited

U.S. PATENT DOCUMENTS

| | | | | |
|---|---|---|---|---|
| 5,398,108 | A | 3/1995 | Morinaga et al. | |
| 5,572,630 | A * | 11/1996 | Azuma | B41J 13/0018 358/1.12 |
| 5,853,171 | A | 12/1998 | Halpenny | |
| 8,025,284 | B2 | 9/2011 | Ikeuchi et al. | |
| 8,167,300 | B1 | 5/2012 | Blair et al. | |
| 8,876,105 | B2 * | 11/2014 | Ohtani | B65H 1/04 271/110 |
| 9,056,732 | B2 * | 6/2015 | Miyamae | B65H 7/02 |
| 2010/0059929 | A1 | 3/2010 | Okumura | |

(Continued)

FOREIGN PATENT DOCUMENTS

| | | | |
|---|---|---|---|
| JP | 2000-289861 | A | 10/2000 |
| JP | 2002-149500 | A | 5/2002 |

(Continued)

OTHER PUBLICATIONS

Mar. 21, 2018—Co-pending U.S. Appl. No. 15/927,176.
Sep. 21, 2018—U.S. Non-Final Office Action—U.S. Appl. No. 15/927,176.

*Primary Examiner* — Howard J Sanders
(74) *Attorney, Agent, or Firm* — Banner & Witcoff, Ltd.

(57) ABSTRACT

A sheet conveying device includes a sheet cassette including a first housing, a pressing plate, a raising plate, a first resilient member, and a second resilient member. The sheet conveying device further includes a second housing, a sheet-cassette accommodating portion, a first electrode, a second electrode, a sheet conveyor, a driver, a first signal output device, and a second signal output device. When controlling the driver to move the raising plate to move the pressing plate upward, the controller detects a state change in the first signal output device from not outputting a conduction signal to outputting the conduction signal; upon this detection, starts counting the number of pulse signals; and determines an amount of upward movement of the pressing plate based on the counted number.

9 Claims, 13 Drawing Sheets

(51) Int. Cl.

| | |
|---|---|
| ***G03G 15/00*** | (2006.01) |
| *B65H 1/14* | (2006.01) |
| *B65H 1/26* | (2006.01) |

(52) U.S. Cl.

CPC ..... *G03G 15/6511* (2013.01); *B65H 1/14* (2013.01); *B65H 1/266* (2013.01); *B65H 2405/1117* (2013.01); *B65H 2511/152* (2013.01); *B65H 2511/22* (2013.01); *B65H 2511/33* (2013.01); *B65H 2553/20* (2013.01); *B65H 2553/232* (2013.01); *B65H 2553/25* (2013.01); *B65H 2553/612* (2013.01); *B65H 2553/82* (2013.01); *B65H 2801/06* (2013.01)

(56) References Cited

U.S. PATENT DOCUMENTS

| | | | |
|---|---|---|---|
| 2016/0101955 | A1 | 4/2016 | Koseki et al. |
| 2017/0341889 | A1 | 11/2017 | Kikuta |
| 2018/0143576 | A1 | 5/2018 | Nishioka |
| 2018/0237244 | A1 | 8/2018 | Hashimoto et al. |

FOREIGN PATENT DOCUMENTS

| | | | |
|---|---|---|---|
| JP | 2007-106539 | A | 4/2007 |
| JP | 2007-168908 | A | 7/2007 |
| JP | 2015-202954 | A | 11/2015 |

* cited by examiner

SHEET CONVEYING DEVICE AND IMAGE FORMING APPARATUS

CROSS REFERENCE TO RELATED APPLICATION

The present application claims priority from Japanese Patent Application No. 2017-032233, which was filed on Feb. 23, 2017, the disclosure of which is herein incorporated by reference in its entirety.

BACKGROUND

The following disclosure relates to a sheet conveying device and an image forming apparatus capable of detecting a sheet remaining amount.

There is conventionally known a sheet conveying device including: a pressing plate movable upward and downward while supporting sheets; and a motor configured to move the pressing plate upward to a suppliable position at which a sheet is in contact with a supply roller and a separating roller. This sheet conveying device calculates the number of the sheets supported on the pressing plate, i.e., a sheet remaining amount, based on a driving time and/or a rotation amount of the motor which is required for the pressing plate to move from the lowest position to the suppliable position.

In this sheet conveying device, a driving mechanism including a plurality of gears transmits a driving force from the motor to the pressing plate. However, there are backlash in the gears and looseness between a shaft and a bearing of the gear in the driving mechanism, for example. Thus, variations are caused in a length of time and a rotation amount of the motor from the start of driving of the motor to the start of actual upward movement of the pressing plate. These variations in the length of time and the rotation amount may cause an error in calculation of the number of the sheets supported on the pressing plate.

To solve this problem, it has been developed a technique of using a sensor to detect a start of operation of a raising plate for moving a pressing plate upward, then measuring the driving time and/or the rotation amount of a motor from the detection of the start of operation of the raising plate to a point in time when the pressing plate moved upward from the lowest position reaches the suppliable position, and then calculating the number of the sheets based on this measured value.

Since the number of the sheets is calculated as described above based on the driving time and/or the rotation amount of the motor from the start of operation of the raising plate, it is possible to remove the variations in the driving time and the rotation amount of the motor which are caused in a period from the start of driving of the motor to the start of operation of the raising plate. This removal reduces an error in the calculated number of the sheets.

SUMMARY

In the sheet conveying device, however, there is a space between the pressing plate located at the lowest position and the raising plate located before the start of its operation. Thus, variations are caused in a driving time and/or a rotation amount of the motor from the start of operation of the raising plate to the start of actual upward movement of the pressing plate. This results in the variations in the driving time and/or the rotation amount of the motor from the start of operation of the raising plate to the point in time when the pressing plate moved upward reaches the suppliable position, making it impossible to sufficiently reduce the error in the calculated number of the sheets.

Accordingly, an aspect of the disclosure relates to a sheet conveying device and an image forming apparatus capable of sufficiently reducing an error in the calculated number of sheets when calculating the number of sheets on a pressing plate based on a driving time and/or a rotation amount of a motor.

In one aspect of the disclosure, a sheet conveying device includes: a sheet cassette including: (i) a first housing configured to accommodate sheets; (ii) a pressing plate formed of a conductive material, provided at the first housing, and movable upward and downward while supporting the sheets; (iii) a raising plate formed of a conductive material, provided at the first housing, and movable from a spaced position at which the raising plate is spaced from the pressing plate to and beyond an initial contact position at which the raising plate contacts the pressing plate and starts moving the pressing plate upward; (iv) a first resilient member formed of a conductive material and provided at the first housing, the first resilient member including a first end portion in contact with the pressing plate, and a second end portion; and (v) a second resilient member formed of a conductive material and provided at the first housing, the second resilient member including a first end portion in contact with the raising plate, and a second portion; a second housing; a sheet-cassette accommodating portion provided at the second housing and accommodating the sheet cassette; a first electrode provided at the sheet-cassette accommodating portion and in contact with the second end portion of the first resilient member; a second electrode provided at the sheet-cassette accommodating portion and in contact with the second end portion of the second resilient member; a sheet conveyor provided at the second housing and configured to convey a sheet from the pressing plate; a driver provided at the second housing and configured to move the raising plate, the driver including: (a) a motor configured to supply a driving force; and (b) a transmission mechanism configured to transmit to the raising plate the driving force supplied from the motor; a first signal output device configured to output a conduction signal when the first electrode and the second electrode are electrically connected to each other; a second signal output device configured to output pulse signals indicating an amount of rotation of the motor; and a controller configured to, when controlling the driver to move the raising plate to move the pressing plate upward: detect a state change in the first signal output device from not outputting the conduction signal to outputting the conduction signal, the state change corresponding to a positional change of the raising plate from the spaced position to the initial contact position; upon detection of the state change in the first signal output device, start counting the number of pulse signals received from the second signal output device; and determine an amount of upward movement of the pressing plate based on the counted number of pulse signals.

In another aspect of the disclosure, a sheet conveying device includes: a pressing plate configured to support sheets and movable upward and downward; a raising plate movable from a spaced position at which the raising plate is spaced from the pressing plate to and beyond an initial contact position at which the raising plate contacts the pressing plate and starts moving the pressing plate upward; a sheet conveyor configured to convey a sheet from the pressing plate; a driver configured to move the raising plate; a sheet sensor configured to detect an uppermost one of the sheets on the pressing plate; and a controller configured to:

control the driver to move the raising plate from the spaced position, via the initial contact position, to such a predetermined position that the sheet sensor detects the uppermost one of the sheets on the pressing plate moved upward by the raising plate; and determine an amount of upward movement of the pressing plate moved by the raising plate, based on an amount of movement of the raising plate from the initial contact position to the predetermined position.

In yet another aspect of the disclosure, an image forming apparatus includes a sheet conveying device and an image former. The sheet conveying device includes: a sheet cassette including: (i) a first housing configured to accommodate sheets; (ii) a pressing plate formed of a conductive material, provided at the first housing, and movable upward and downward while supporting the sheets; (iii) a raising plate formed of a conductive material, provided at the first housing, and movable from a spaced position at which the raising plate is spaced from the pressing plate to and beyond an initial contact position at which the raising plate contacts the pressing plate and starts moving the pressing plate upward; (iv) a first resilient member formed of a conductive material and provided at the first housing, the first resilient member including a first end portion in contact with the pressing plate, and a second end portion; and (v) a second resilient member formed of a conductive material and provided at the first housing, the second resilient member including a first end portion in contact with the raising plate, and a second portion; a second housing; a sheet-cassette accommodating portion provided at the second housing and accommodating the sheet cassette; a first electrode provided at the sheet-cassette accommodating portion and in contact with the second end portion of the first resilient member; a second electrode provided at the sheet-cassette accommodating portion and in contact with the second end portion of the second resilient member; a sheet conveyor provided at the second housing and configured to convey a sheet from the pressing plate; a driver provided at the second housing and configured to move the raising plate, the driver including: (a) a motor configured to supply a driving force; and (b) a transmission mechanism configured to transmit to the raising plate the driving force supplied from the motor; a first signal output device configured to output a conduction signal when the first electrode and the second electrode are electrically connected to each other; a second signal output device configured to output pulse signals indicating an amount of rotation of the motor; and a controller configured to, when controlling the driver to move the raising plate to move the pressing plate upward: detect a state change in the first signal output device from not outputting the conduction signal to outputting the conduction signal, the state change corresponding to a positional change of the raising plate from the spaced position to the initial contact position; upon detection of the state change in the first signal output device, start counting the number of pulse signals received from the second signal output device; and determine an amount of upward movement of the pressing plate based on the counted number of pulse signals. The image former is provided in the second housing and configured to form an image on the sheet conveyed from the sheet conveying device by the sheet conveyor.

BRIEF DESCRIPTION OF THE DRAWINGS

The objects, features, advantages, and technical and industrial significance of the present disclosure will be better understood by reading the following detailed description of an embodiment, when considered in connection with the accompanying drawings, in which.

DETAILED DESCRIPTION OF THE EMBODIMENT

Hereinafter, there will be described an embodiment by reference to the drawings.

Overall Configuration of Image Forming Apparatus

Figure 1:
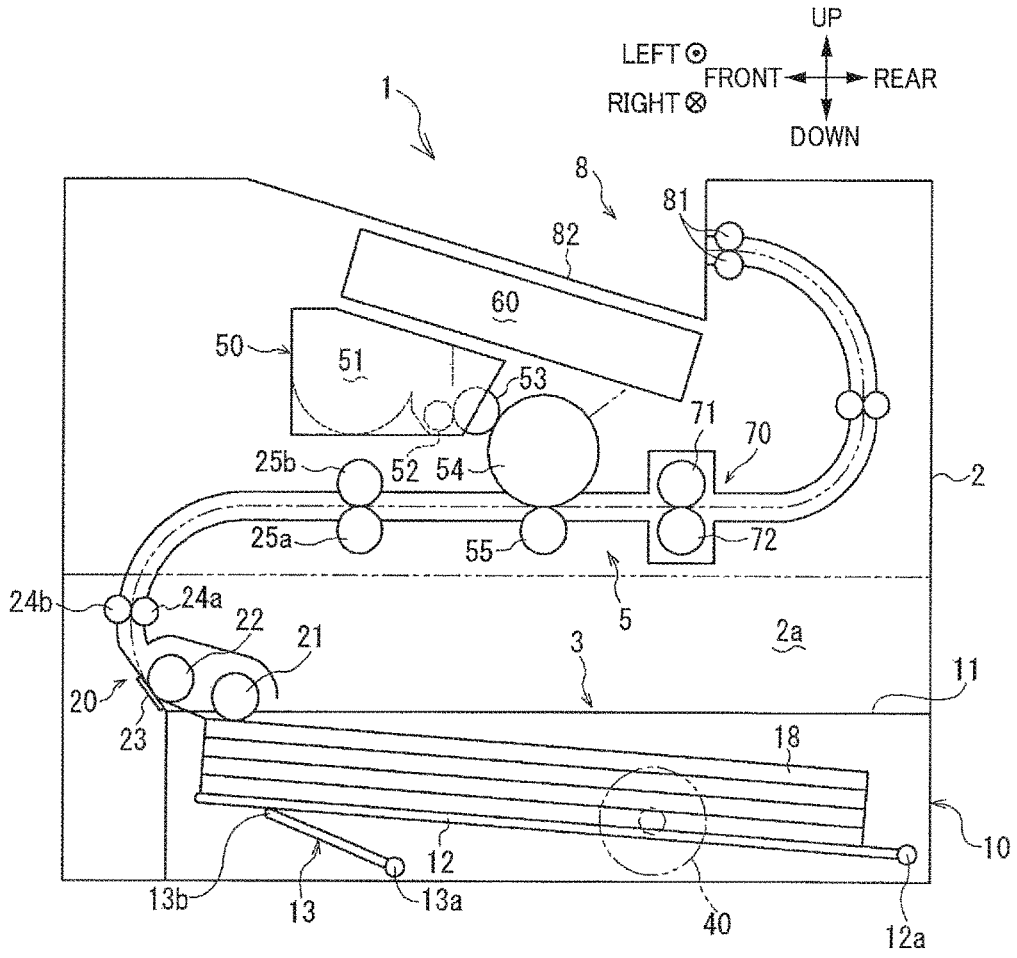
FIG. 1 is a cross-sectional view of a central portion of an image forming apparatus.

FIG. 1 is an image forming apparatus 1 according to one embodiment. The image forming apparatus 1 includes: a body housing 2; a supply unit 3 including a sheet cassette 10 and a sheet conveyor 20; a sheet-cassette accommodating portion 2*a* provided in the body housing 2 to accommodate the sheet cassette 10; an image forming unit 5; a driver 4 (see FIG. 2) including a motor 40 configured to supply a driving force and a transmission mechanism 41 configured to transmit the driving force supplied from the motor 40; and a controller 6 (see FIG. 5).

In the following description, a left side and a right side in FIG. 1, and a front side and a back side of the sheet of FIG. 1 are respectively defined as a front side, a rear side, a left side, and a right side of the image forming apparatus 1. Furthermore, an upper side and a lower side in FIG. 1 are respectively defined as an upper side and a lower side of the image forming apparatus 1.

The body housing 2 is a box having a substantially rectangular parallelepiped shape. The body housing 2 accommodates the supply unit 3, the image forming unit 5, the driver 4, and the controller 6. A lower portion of the body housing 2 serves as the sheet-cassette accommodating portion 2*a*. The sheet cassette 10 is insertable in and removable from the sheet-cassette accommodating portion 2*a*. The body housing 2 is one example of a second housing.

The supply unit 3 is disposed in a lower portion of the image forming apparatus 1. The sheet conveyor 20 of the supply unit 3 supplies each of sheets 18 from the sheet cassette 10 to the image forming unit 5.

The sheet cassette 10 is movable between an accommodated position and a separated position. At the accommodated position, the sheet cassette 10 is accommodated in the sheet-cassette accommodating portion 2*a* at a predetermined position. At the separated position, the sheet cassette 10 is separated from the sheet-cassette accommodating portion 2*a* and is not accommodated in the sheet-cassette accommodating portion 2*a*. The sheet cassette 10 located at the accommodated position is moved frontward to the separated position. The sheet cassette 10 located at the separated position is moved rearward to the accommodated position. The supply unit 3 includes a cassette sensor 93 (see FIG. 5) configured to detect whether the sheet cassette 10 is accommodated in the sheet-cassette accommodating portion 2*a*.

Figure 2:
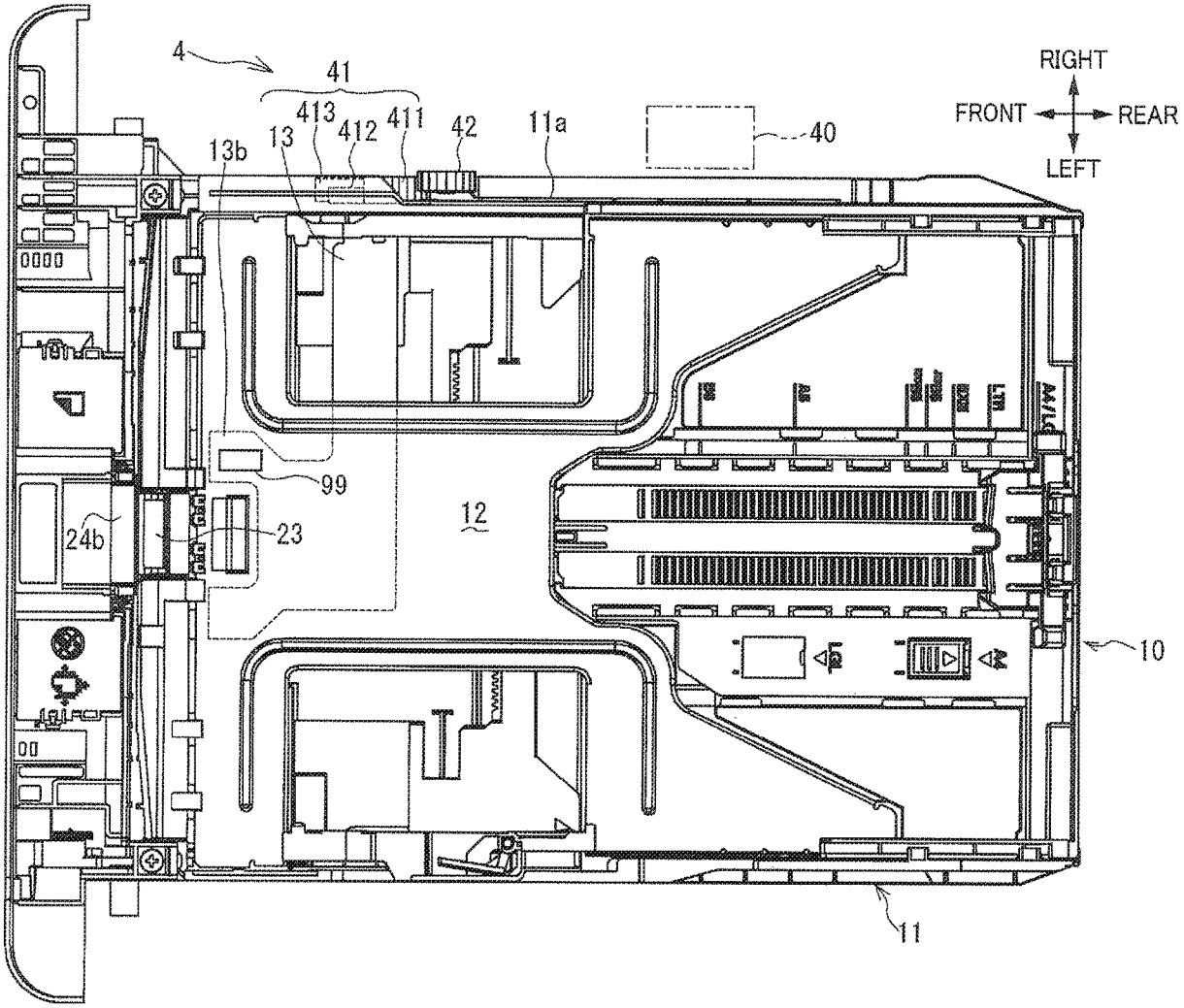
FIG. 2 is a plan view of a sheet cassette.

As illustrated in FIG. 2, the sheet cassette 10 includes: a cassette body 11 capable of storing the sheets 18; a pressing plate 12 disposed in the cassette body 11 movably upward and downward to support the sheets 18 thereon; and a raising plate 13 disposed under the pressing plate 12 in the cassette body 11 and movable between a spaced position and a contact position. At the spaced position, the raising plate 13 is spaced from the pressing plate 12. At the contact position, the raising plate 13 is in contact with the pressing plate 12 to raise or lower the pressing plate 12.

The pressing plate 12 is supported by the cassette body 11 so as to be pivotable about a pivot axis 12*a* located at a rear end portion of the pressing plate 12. The pivotal movement of the pressing plate 12 about the pivot axis 12*a* moves a front end portion of the pressing plate 12 upward or downward in the up and down direction.

The raising plate 13 is supported by the cassette body 11 so as to be pivotable about a pivot axis 13*a* located at a rear end portion of the raising plate 13. The pivotal movement of the raising plate 13 about the pivot axis 13*a* moves the raising plate 13 between the spaced position at which the raising plate 13 is spaced from the pressing plate 12 and the contact position at which the raising plate 13 is in contact with the pressing plate 12 to move the pressing plate 12 upward and downward. A front end portion of the raising plate 13 serves as a contact portion 13*b* contactable with a lower surface of the pressing plate 12. The raising plate 13 is driven by the driving force supplied from the motor 40. Each of the pressing plate 12 and the raising plate 13 is a conductor of electricity which is formed of a material such as galvanized sheet iron and conductive resin.

The transmission mechanism 41 is configured to transmit the driving force supplied from the motor 40, to the raising plate 13. As illustrated in FIG. 2, the transmission mechanism 41 is disposed on a right outer surface 11*a* of the cassette body 11. The transmission mechanism 41 includes: a pressing-plate raising gear 411 engageble with a pressing-plate driving gear 42 connected to the motor 40; a gear 412 disposed downstream of the pressing-plate raising gear 411 in a driving-force transmitting direction and engaged with the pressing-plate raising gear 411; and a gear 413 disposed downstream of the gear 412 in the driving-force transmitting direction and engaged with the gear 412. The gear 413 is connected to the raising plate 13.

The driving force supplied from the motor 40 is input to the pressing-plate raising gear 411 via the pressing-plate driving gear 42. The driving force input to the pressing-plate driving gear 42 is transmitted to the raising plate 13 via the gear 412 and the gear 413 to drive the raising plate 13. Here, the raising plate 13 located at the spaced position is driven by the motor 40 so as to pivot about the pivot axis 13*a* of the raising plate 13, so that the contact portion 13*b* is brought into contact with the pressing plate 12. In this movement, the raising plate 13 pivots in a direction directed from the spaced position toward the pressing plate 12.

When the raising plate 13 located at the spaced position is driven by the motor 40 and pivots in the up direction (i.e., the direction directed from the spaced position toward the pressing plate 12, the raising plate 13 reaches the contact position at which the contact portion 13*b* is in contact with the pressing plate 12. A position of the raising plate 13 at a timing when the raising plate 13 contacts and starts raising the pressing plate 12 is an initial contact position different from the spaced position. After the raising plate 13 has reached the initial contact position, the pressing plate 12 is moved upward, with the contact portion 13*b* kept in contact with the pressing plate 12. The pressing plate 12 located at its lowest position is moved upward by the raising plate 13 to a sheet suppliable position at which the sheets 18 supported on the pressing plate 12 become suppliable. It is noted that this state is illustrated in FIG. 1, and the sheet suppliable position may be hereinafter used also for the sheets 18.

The pressing-plate driving gear 42 is provided on the body housing 2. When the sheet cassette 10 is located at the accommodated position, the pressing-plate driving gear 42 and the pressing-plate raising gear 411 of the transmission mechanism 41 are engaged with each other, so that the driving force supplied from the motor 40 is input to the transmission mechanism 41. When the sheet cassette 10 is located at the separated position, the pressing-plate driving gear 42 and the pressing-plate raising gear 411 are disengaged from each other, so that the driving force supplied from the motor 40 is not input to the transmission mechanism 41.

When the sheet cassette 10 is located at the accommodated position, after the pressing plate 12 is moved upward by the raising plate 13, reverse rotation of the pressing-plate driving gear 42 is prevented by a reverse-rotation preventing mechanism provided between the motor 40 and the pressing-plate driving gear 42. Thus, even when rotation of the motor 40 is stopped, the pressing plate 12 is kept at its upper position. In the state in which the pressing plate 12 is kept at the upper position, the pressing plate 12 and the raising plate 13 are in contact with each other.

When the sheet cassette 10 is moved from the accommodated position to the separated position in the state in which the pressing plate 12 has been moved upward by the raising plate 13, the pressing-plate driving gear 42 and the pressing-plate raising gear 411 disengage from each other. Thus, the pressing plate 12 moves downward to the lowest position, and the raising plate 13 moves downward to the spaced position. In the state in which the pressing plate 12 is located at the lowest position, and the raising plate 13 is located at the spaced position, the pressing plate 12 and the raising plate 13 are spaced from each other.

The sheet conveyor 20 is a mechanism configured to separate an uppermost one of the sheets 18 stored in the sheet cassette 10 from the others and convey the uppermost sheet 18 toward the image forming unit 5. The sheet conveyor 20 includes a pickup roller 21, a separating roller 22, a separator pad 23, a conveying roller 24*a*, and a registering roller 25*a*.

The pickup roller 21 picks up the sheets 18 moved upward to the sheet suppliable position by the pressing plate 12. The pickup roller 21 is disposed above the front end portion of the pressing plate 12. In a state in which the sheets 18 placed on the pressing plate 12 are located at the sheet suppliable position, the sheets 18 are suppliable with an upper end thereof kept in pressing contact with the pickup roller 21 at an appropriate pressure.

In the case where the sheets 18 are supported on the pressing plate 12 being moved upward by the raising plate 13, when the pressing plate 12 is moved to the sheet suppliable position at which an upper end of the sheets 18 is in pressing contact with the pickup roller 21, the upward movement of the pressing plate 12 is stopped.

In the case where the sheets 18 are not supported on the pressing plate 12, when the pressing plate 12 reaches the highest position in a movable area of the pressing plate 12 in the up and down direction, the upward movement of the pressing plate 12 is stopped. The highest position in the movable area of the pressing plate 12 in the up and down direction is set at a position at which the pressing plate 12 is in pressing contact with the pickup roller 21, for example.

The separating roller 22 is disposed downstream of the pickup roller 21 in a sheet conveying direction in which the sheet 18 is conveyed. The separator pad 23 is opposed to the separating roller 22 and urged toward the separating roller 22. The sheets 18 picked up by the pickup roller 21 are supplied toward the separating roller 22 and separated from one another between the separating roller 22 and the separator pad 23, and the separated sheet 18 is conveyed toward the conveying roller 24*a*.

The conveying roller 24*a* applies a conveyance force to the sheet 18 and is disposed downstream of the separating roller 22 in the sheet conveying direction. A sheet-dust removing roller 24*b* is opposed to the conveying roller 24*a*. The sheet 18 conveyed toward the conveying roller 24*a* is nipped by the conveying roller 24*a* and the sheet-dust removing roller 24*b* and conveyed toward the registering roller 25*a*.

The registering roller 25*a* is disposed downstream of the conveying roller 24*a* in the sheet conveying direction. A registering roller 25*b* is opposed to the registering roller 25*a*. The registering roller 25*a* cooperates with the registering roller 25*b* to temporarily stop movement of a leading edge of the sheet 18 being conveyed and then conveys the sheet 18 toward a transfer position at a predetermined timing.

The image forming unit 5 is disposed downstream of the supply unit 3 in the sheet conveying direction and configured to form an image on the sheet 18 conveyed from the supply unit 3.

The image forming unit 5 includes: a process cartridge 50 configured to transfer an image onto a surface of the sheet 18 conveyed from the supply unit 3; an exposing unit 60 configured to expose a surface of a photoconductor drum 54 of the process cartridge 50; and a fixing unit 70 configured to fix the image transferred to the sheet 18 by the process cartridge 50.

The process cartridge 50 is disposed in the body housing 2 at a position located above the sheet-cassette accommodating portion 2*a*. The process cartridge 50 includes a developer storage chamber 51, a supply roller 52, a developing roller 53, the photoconductor drum 54, and a transfer roller 55.

The exposing unit 60 includes a laser diode, a polygon mirror, lenses, and a reflective mirror. The exposing unit 60 exposes the surface of the photoconductor drum 54 by emitting laser light toward the photoconductor drum 54 based on image data input to the image forming apparatus 1.

The developer storage chamber 51 contains toner as a developer. The toner contained in the developer storage chamber 51 is supplied to the supply roller 52 while being agitated by an agitator, not illustrated. The toner supplied from the developer storage chamber 51 is further supplied to the developing roller 53 by the supply roller 52.

The developing roller 53 is disposed in close contact with the supply roller 52 and configured to bear the toner supplied from the supply roller 52 and positively charged by a slider, not illustrated. Also, a positive developing bias is applied to the developing roller 53 by a bias applier, not illustrated.

The photoconductor drum 54 is disposed next to the developing roller 53. The surface of the photoconductor drum 54 is positively charged uniformly by a charging unit, not illustrated, and then exposed by the exposing unit 60. Areas of the photoconductor drum 54 that are exposed to light are lower in electric potential than the other area of the photoconductor drum 54, so that an electrostatic latent image is formed on the photoconductor drum 54 based on the image data. The positively charged toner is supplied from the developing roller 53 to the surface of the photoconductor drum 54 with the electrostatic latent image formed thereon, whereby the electrostatic latent image is made visible to form a developed image.

The transfer roller 55 is opposed to the photoconductor drum 54, and a negative transfer bias is applied to the transfer roller 55 by the bias applier, not illustrated. At the transfer position, the sheet 18 is nipped between and conveyed by the photoconductor drum 54 with the developed image formed thereon and the transfer roller 55 with the transfer bias on the surface of the transfer roller 55. As a result, the developed image formed on the surface of the photoconductor drum 54 is transferred to the surface of the sheet 18.

The fixing unit 70 includes a heat roller 71 and a pressure roller 72. The heat roller 71 is rotated by the driving force supplied from the motor 40 and is heated by electric power supplied from a power source, not illustrated. The pressure roller 72 is opposed to the heat roller 71 and rotated by the heat roller 71 in close contact therewith. When the sheet 18 on which the developed image is transferred is conveyed to the fixing unit 70, the sheet 18 is nipped and conveyed by the heat roller 71 and the pressure roller 72 to fix the developed image to the sheet 18.

A discharge unit 8 is disposed downstream of the image forming unit 5 in the sheet conveying direction and configured to discharge the sheet 18 on which the image is formed by the image forming unit 5, to an outside of the body housing 2. The discharge unit 8 includes a pair of discharge rollers 81 and a discharge tray 82. The discharge rollers 81 discharge the sheet 18 conveyed from the fixing unit 70, to the outside of the body housing 2. The discharge tray 82 is formed on an upper surface of the body housing 2 so as to support the sheets 18 discharged by the discharge rollers 81 to the outside of the body housing 2 and stacked on each other.

The image forming apparatus 1 includes a sheet sensor 9 configured to contact and detect an uppermost one of the sheets 18 supported on the pressing plate 12 when the pressing plate 12 is moved upward from the lowest position. As illustrated in FIG. 3, the sheet sensor 9 is a contact sensor including a contact member 91 and a detector 92. When the pressing plate 12 is moved upward, pivotal movement of the contact member 91 is caused by contacting the sheets 18 supported on the pressing plate 12, and the detector 92 detects the contact member 91 having pivoted. This configuration enables the sheet sensor 9 to detect the uppermost sheet 18 when the pressing plate 12 is moved upward.

Figure 3A:
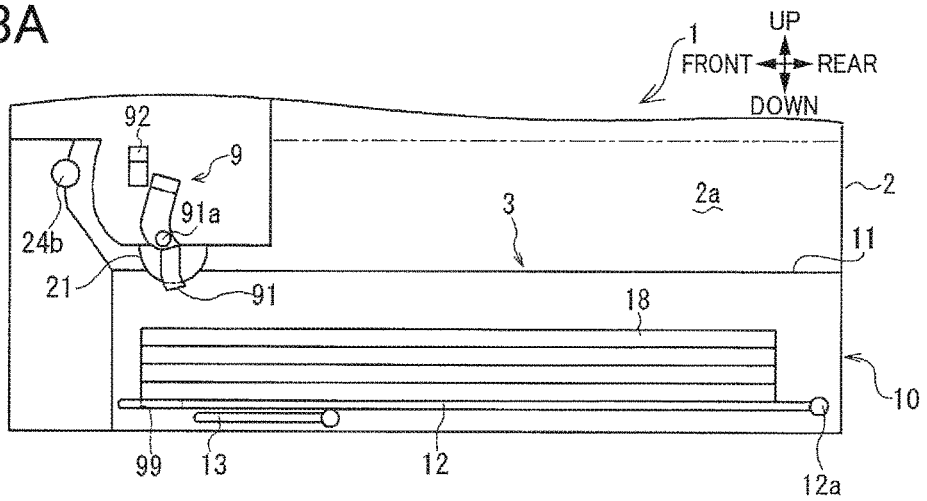
FIG. 3A is a side elevational view in cross section, illustrating the image forming apparatus in a state in which a pressing plate supporting sheets is located at a lowest position.
Figure 3B:
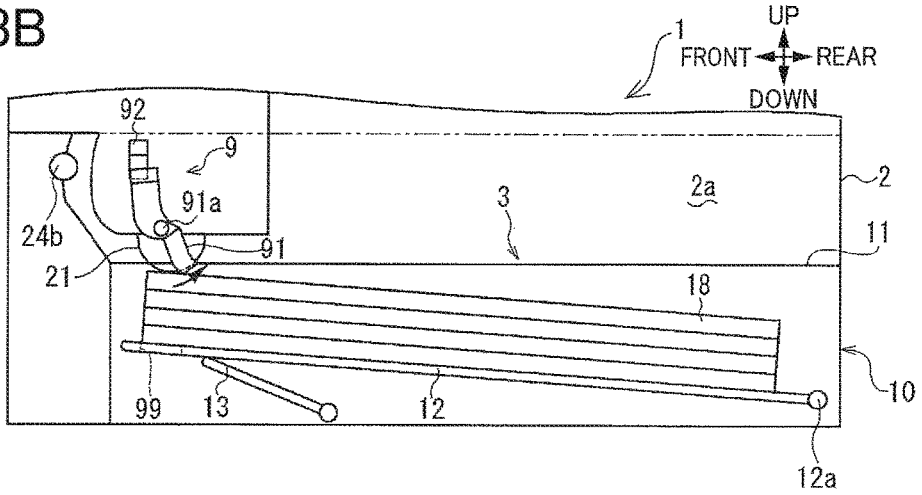
FIG. 3B is a side elevational view in cross section, illustrating the image forming apparatus in a state in which a sheet sensor is in contact with an uppermost sheet by upward movement of the pressing plate supporting the sheets.

Specifically, as illustrated in FIG. 3A, when the pressing plate 12 is located at the lowest position, for example, the contact member 91 does not pivot because the contact member 91 does not contact the sheets 18 supported on the pressing plate 12. Accordingly, the detector 92 does not detect pivotal movement of the contact member 91, and the sheet sensor 9 does not detect the sheets 18. In contrast, as illustrated in FIG. 3B, when the pressing plate 12 is moved upward from the lowest position, the contact member 91 contacts the uppermost sheet 18 and pivots about a pivot center 91*a*, so that the detector 92 detects the contact member 91 having pivoted. As a result, the sheet sensor 9 detects the uppermost sheet 18.

Figure 3C:
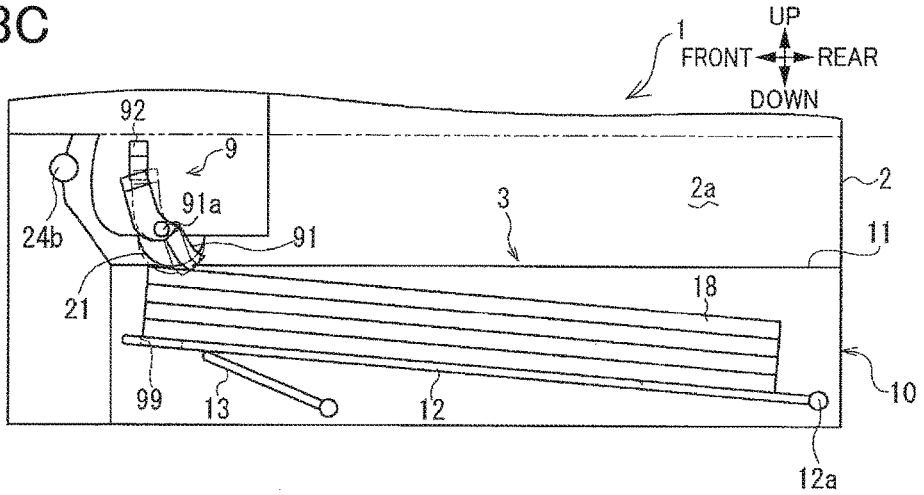
FIG. 3C is a side elevational view in cross section, illustrating the image forming apparatus in a state in which a pickup roller is in contact with the uppermost sheet by upward movement of the pressing plate supporting the sheets.

In the case where the pressing plate 12 is moved upward by the driving force of the motor 40 via the raising plate 13, the upward movement of the pressing plate 12 continues even after the contact member 91 contacts the uppermost sheet 18. As illustrated in FIG. 3C, when the pressing plate 12 is moved upward after the contact member 91 contacts the uppermost sheet 18, the upper end of the sheets 18 supported on the pressing plate 12 is brought into contact with the pickup roller 21. The pickup roller 21, which is movable upward and downward, is moved upward by the sheets 18 being in contact with the pickup roller 21.

When the pickup roller 21 is pushed upward by the sheets 18, a clutch disengages transmission of the driving force from the motor 40 to the raising plate 13, so that the upward movement of the pressing plate 12 is stopped. The position of the pressing plate 12 at which the upward movement of the pressing plate 12 is stopped is the sheet suppliable position at which the sheet 18 is suppliable in the state in which the upper end of the sheets 18 is in pressing contact with the pickup roller 21.

The image forming apparatus 1 is configured to calculate the number of the sheets 18 stored in the sheet cassette 10, based on an amount of upward movement of the pressing plate 12 from the lowest position to a position at which the sheet sensor 9 detects the sheets 18. In this calculation, the amount of upward movement of the pressing plate 12 is obtained based on the number of rotations of the motor 40, for example.

In the case where no sheets 18 are placed on the pressing plate 12, even when the pressing plate 12 is moved upward to the position of the contact member 91, the contact member 91 does not pivot, and the sheet sensor 9 does not detect the sheets 18.

Specifically, as illustrated in FIG. 2, a hole 99 is formed through the pressing plate 12. In a state in which no sheets 18 are placed on the pressing plate 12, a position of the hole 99 in the pressing plate 12 is such a position that the contact member 91 is partly located in the hole 99 and does not pivot even when the pressing plate 12 is moved upward. In the state in which the sheets 18 are placed on the pressing plate 12, the position of the hole 99 in the pressing plate 12 is such a position that the hole 99 is covered with the sheets 18, and the contact member 91 pivots by contacting the sheet 18 when the pressing plate 12 is moved upward.

Figure 4A:
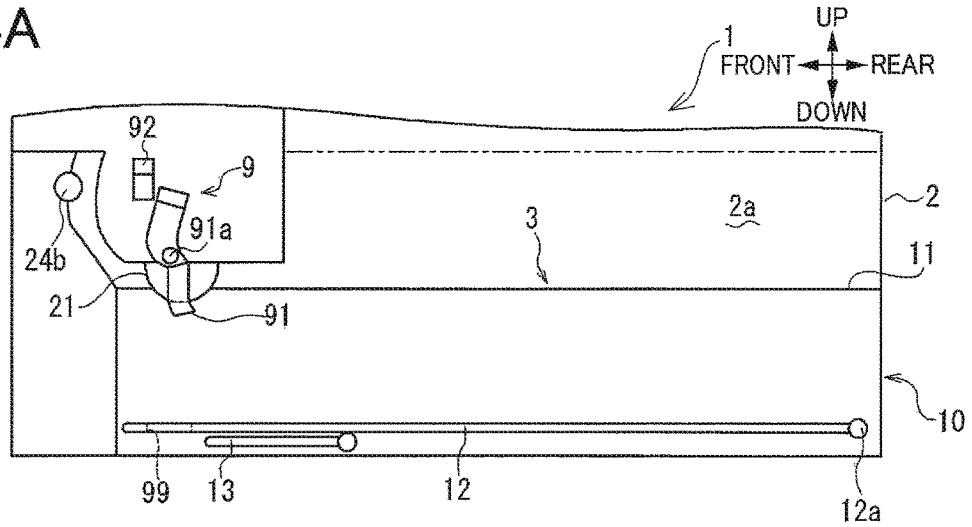
FIG. 4A is a side elevational view in cross section, illustrating the image forming apparatus in a state in which the pressing plate supporting no sheets is located at the lowest position.

For example, as illustrated in FIG. 4A, in a state in which the pressing plate 12 supporting no sheets 18 is located at the lowest position, the contact member 91 does not contact the pressing plate 12 and thus does not pivot. Accordingly, the detector 92 does not detect pivotal movement of the contact member 91, and thus the sheet sensor 9 detects no sheets 18. In a state in which the pressing plate 12 supporting no sheets 18 is moved upward and located at a position illustrated in FIG. 4B, one end portion of the pressing plate 12 is located above a lower end of the contact member 91, but the contact member 91 does not pivot because the contact member 91 is partly located in the hole 99 formed in the pressing plate 12. Accordingly, the sheet sensor 9 detects no sheets 18.

Figure 4B:
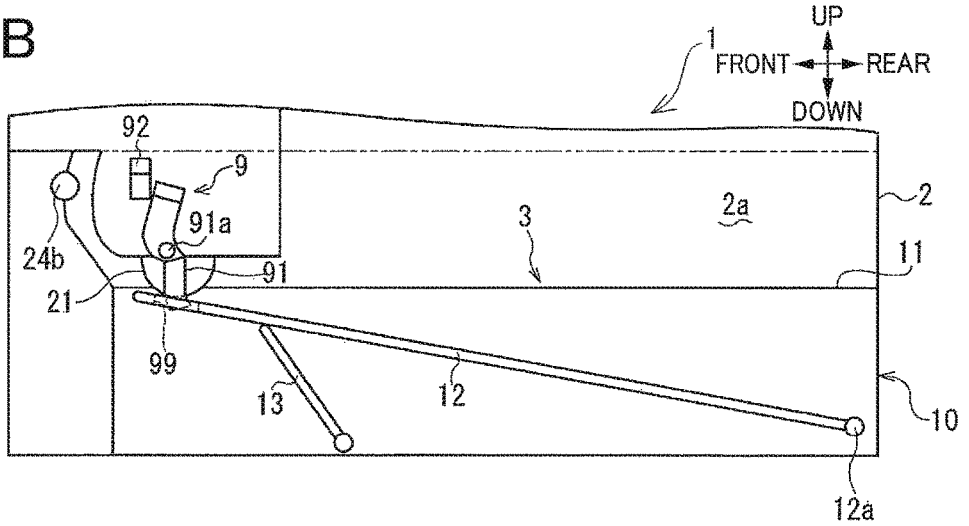
FIG. 4B is a side elevational view in cross section, illustrating the image forming apparatus in a state in which the pressing plate supporting no sheets is moved upward to a position of the sheet sensor.
Figure 4C:
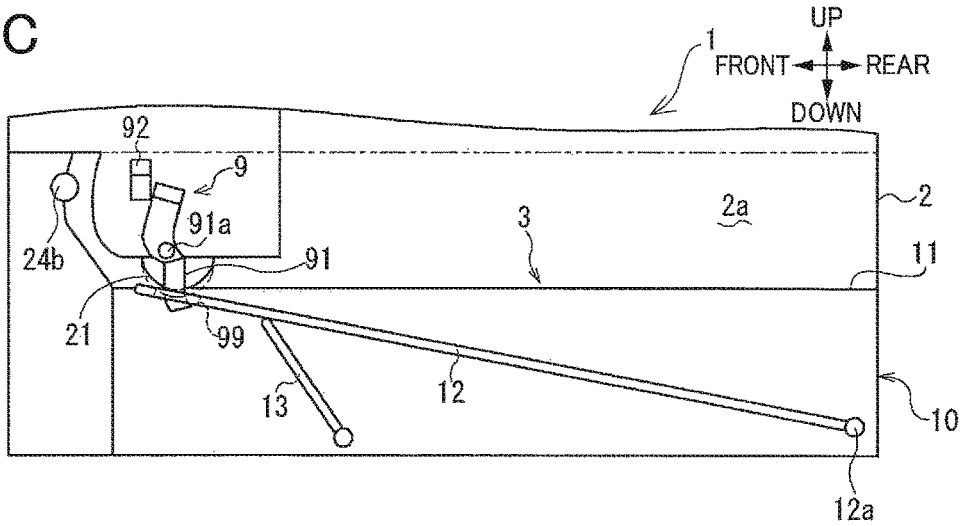
FIG. 4C is a side elevational view in cross section, illustrating the image forming apparatus in a state in which the pickup roller is in contact with the pressing plate by upward movement of the pressing plate supporting no sheets.

When the pressing plate 12 moved upward to the position illustrated in FIG. 4B is further moved upward, as illustrated in FIG. 4C, the pressing plate 12 is brought into contact with the pickup roller 21. The pressing plate 12 having contacted the pickup roller 21 pushes the pickup roller 21 upward. When the pickup roller 21 is pushed upward by the pressing plate 12, the clutch disengages the transmission of the driving force from the motor 40 to the raising plate 13, so that the upward movement of the pressing plate 12 is stopped. The upper position of the pressing plate 12 when this upward movement of the pressing plate 12 is stopped is the highest position in the movable area of the pressing plate 12 in the up and down direction.

In the configuration as described above, the pressing plate 12 has the hole 99, and the detector 92 detects the presence or absence of pivotal movement of the contact member 91 when the pressing plate 12 is moved upward. This makes it possible to determine whether the sheet or sheets 18 are placed on the pressing plate 12.

The controller 6 is provided in the body housing 2 and controls operations of the motor 40. Furthermore, when moving the pressing plate 12 upward via the raising plate 13 by the driving force supplied from the motor 40, the controller 6 measures a rotation amount of the motor 40 and calculates the number of the sheets 18 stored in the sheet cassette 10, based on the measured rotation amount.

Figure 5:
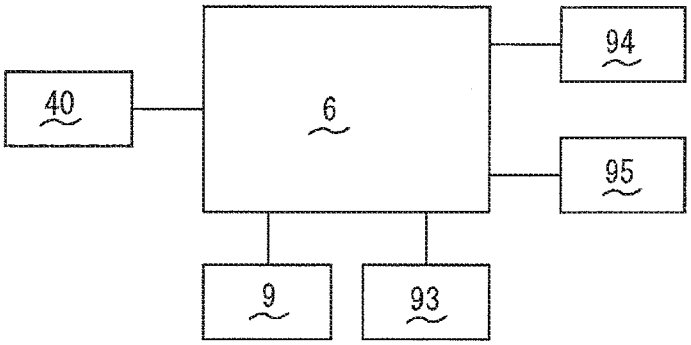
FIG. 5 is a block diagram illustrating a controller, and a motor, a sheet sensor, a cassette sensor, a first signal output device, and a second signal output device which are connected to the controller.

As illustrated in FIG. 5, the motor 40, the sheet sensor 9, and the cassette sensor 93 are connected to the controller 6. The image forming apparatus 1 includes: a first signal output device 94 configured to output a conduction signal when the pressing plate 12 and the raising plate 13 are electrically connected to each other by contact therebetween; and a second signal output device 95 configured to output a pulse signal indicating the rotation amount of the motor 40. The first signal output device 94 and the second signal output device 95 are connected to the controller 6. The controller 6 is configured to receive the conduction signal output from the first signal output device 94 and the pulse signal output from the second signal output device 95.

Figure 6:
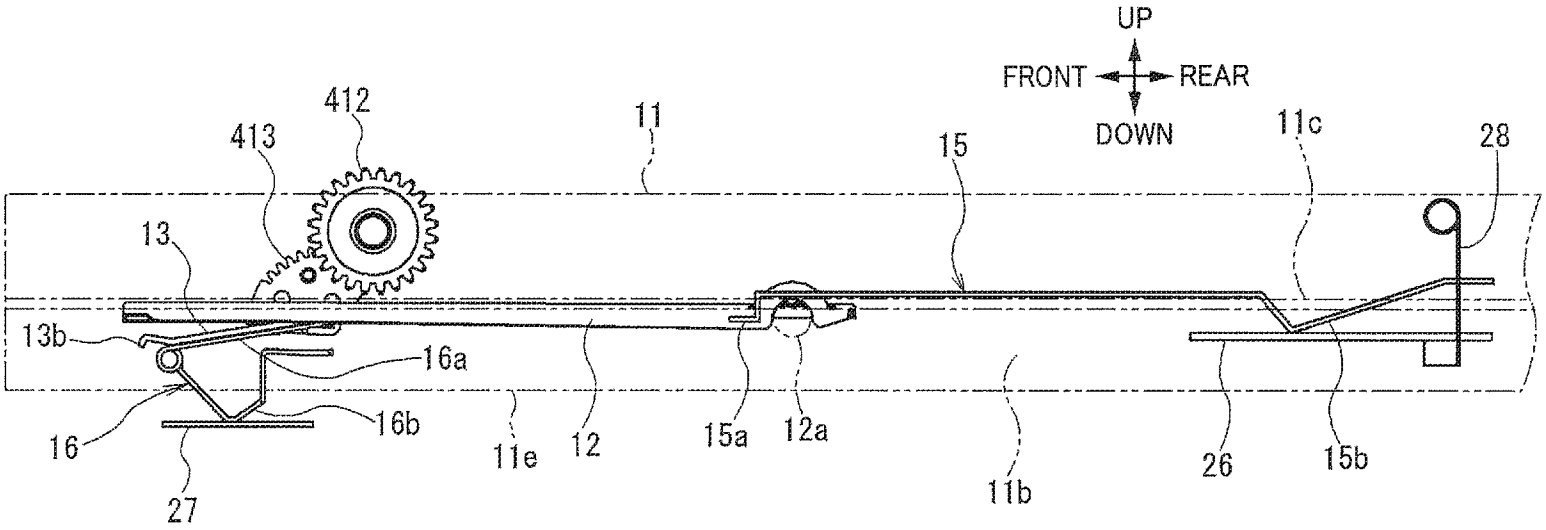
FIG. 6 is a side view of the sheet cassette located at an accommodated position, a raising plate located at a spaced position, a first resilient member and a second resilient member provided on the sheet cassette, and a first electrode and a second electrode provided on a sheet-cassette accommodating portion.
Figure 7:
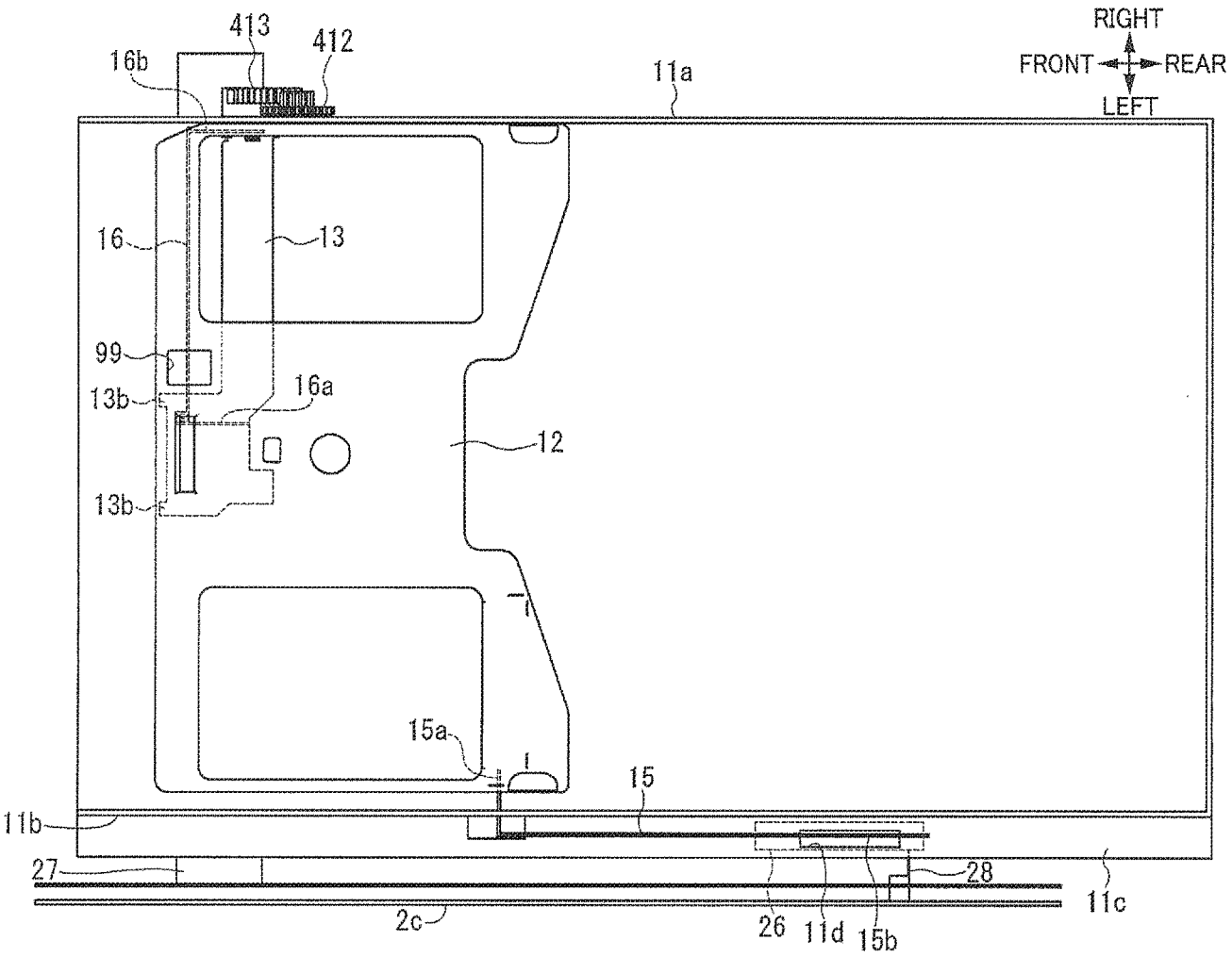
FIG. 7 is a plan view of the sheet cassette located at the accommodated position, the raising plate located at the spaced position, the first resilient member and the second resilient member provided on the sheet cassette, and the first electrode and the second electrode provided on the sheet-cassette accommodating portion.
Figure 8:
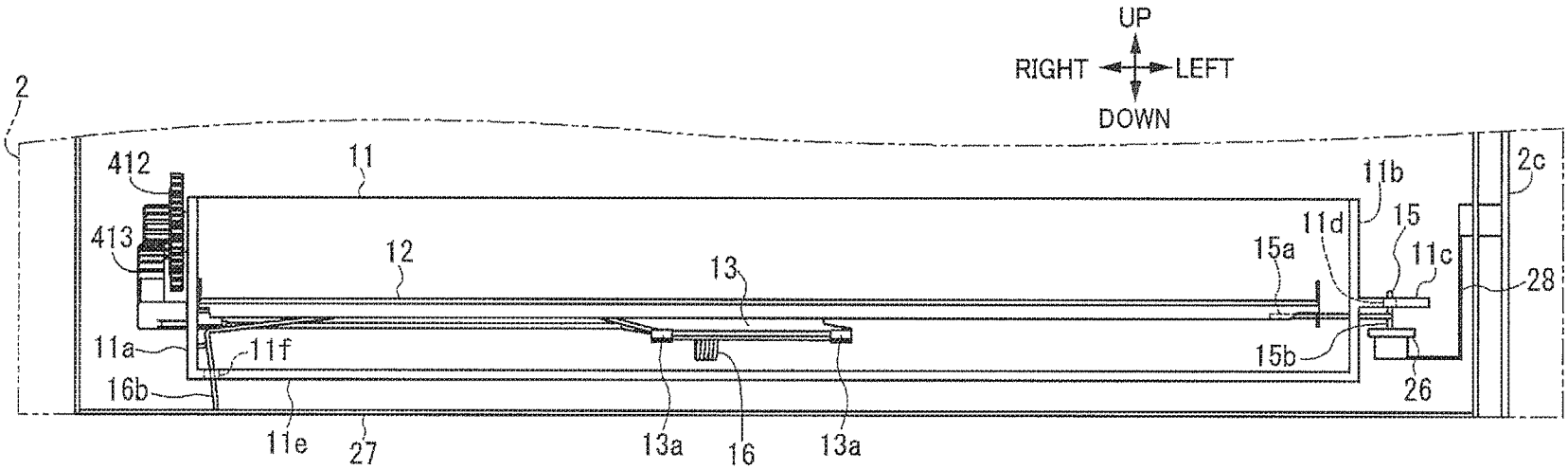
FIG. 8 is a front elevational view of the sheet cassette located at the accommodated position, the raising plate located at the spaced position, the first resilient member and the second resilient member provided on the sheet cassette, and the first electrode and the second electrode provided on the sheet-cassette accommodating portion.

Configuration for Reducing Calculation Error in Number of Sheets stored in Sheet Cassette As illustrated in FIGS. 6-8, the sheet cassette 10 includes: a first resilient member 15 provided on the cassette body 11 and in contact with a back surface of the pressing plate 12; and a second resilient member 16 provided on the cassette body 11 and in contact with the back surface of the raising plate 13.

A first end portion 15*a* of the first resilient member 15 is kept in contact with the back surface of the pressing plate 12 during movement of the pressing plate 12 in the up and down direction. The first resilient member 15 has electric conductivity and resiliency. For example, the first resilient member 15 is formed of a wire spring. The first resilient member 15 is disposed on a left side portion of the cassette body 11. The first end portion 15*a* of the first resilient member 15 is in contact with the back surface of the pressing plate 12 at a position near the pivot axis 12*a*.

A portion of the first resilient member 15 near its second end extends to a position located to the left of a left outer surface 11*b* of the cassette body 11. A rib 11*c* protruding leftward is formed on the outer surface 11*b* of the cassette body 11. A second end portion 15*b* of the first resilient member 15 is partially located below the rib 11*c*. The rib 11*c* has a through hole 11*d* through which the second end portion 15*b* partially protrudes below the rib 11*c*.

A first end portion 16*a* of the second resilient member 16 is kept in contact with the back surface of the raising plate 13 during movement of the raising plate 13 in the up and down direction. The second resilient member 16 has electric conductivity and resiliency. For example, the second resilient member 16 is formed of a torsion spring. The second resilient member 16 is disposed in a compressed state between the raising plate 13 and a bottom surface of the cassette body 11. A second end portion 16*b* of the second resilient member 16 partially protrudes downward to a position located below a bottom surface 11*e* of the cassette body 11. The bottom surface 11*e* of the cassette body 11 has a through hole 11*f* (see FIG. 8) through which the second end portion 16*b* partially protrudes to the position located below the bottom surface 11*e*.

A first electrode 26 and a second electrode 27 are provided on the sheet-cassette accommodating portion 2*a* of the body housing 2. The first electrode 26 is in contact with the second end portion 15*b* of the first resilient member 15 when the sheet cassette 10 is located at the accommodated position. The second electrode 27 is in contact with the second end portion 16*b* of the second resilient member 16 when the sheet cassette 10 is located at the accommodated position.

The first electrode 26 is plate-shaped and disposed on the left side portion of the sheet cassette 10. The first electrode 26 is a conductor of electricity. When the sheet cassette 10 is located at the accommodated position, the first electrode 26 is disposed under the rib 11*c* located on a left side of the cassette body 11. The first electrode 26 is in contact with the second portion 15*b* of the first resilient member 15 protruding downward from the rib 11*c*. The first electrode 26 is held in pressing contact with the first resilient member 15 such that the first resilient member 15 is bent against the resilient force of the first resilient member 15. The second portion 15*b* of the first resilient member 15 is in contact with the first electrode 26 so as to be slidable in the front and rear direction in which the sheet cassette 10 is moved.

A circuit board 2*c* is disposed in the body housing 2 at a position located to the left of the sheet cassette 10. The first signal output device 94 and the second signal output device 95 are mounted on the circuit board 2*c*. The first electrode 26 is connected to the circuit board 2*c* by a wiring 28. The first electrode 26 is electrically connected to the first signal output device 94.

The second electrode 27 is a conductive frame for reinforcing the body housing 2. When the sheet cassette 10 is located at the accommodated position, the second electrode 27 is disposed and grounded at a position which is located under the sheet cassette 10 and to which the second resilient member 16 protrudes. The second electrode 27 is held in pressing contact with the second resilient member 16 such that the second resilient member 16 is bent against the resilient force of the second resilient member 16. The second end portion 16*b* of the second resilient member 16 is in contact with the second electrode 27 so as to be slidable in the front and rear direction in which the sheet cassette 10 is moved.

Figure 10:
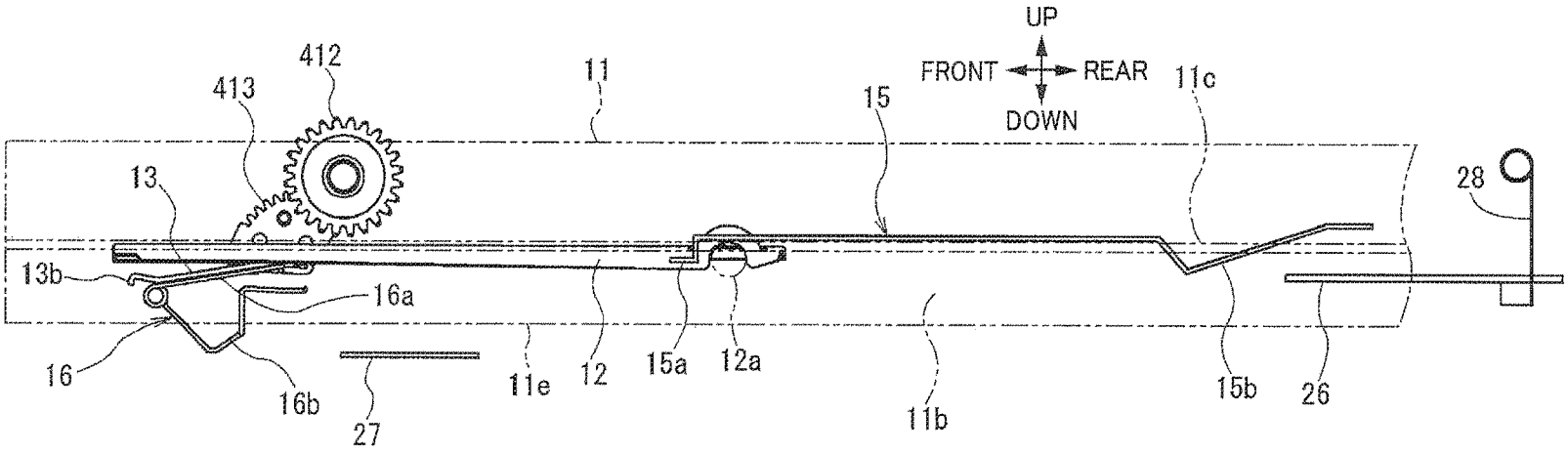
FIG. 10 is a side view of the sheet cassette located at a separated position, the raising plate located at the spaced position, the first resilient member and the second resilient member provided on the sheet cassette, and the first electrode and the second electrode provided on the sheet-cassette accommodating portion.

When the sheet cassette 10 is located at the accommodated position, as described above, the second end portion 15*b* of the first resilient member 15 is in contact with the first electrode 26 so as to be slidable in the front and rear direction, and the second end portion 16*b* of the second resilient member 16 is in contact with the second electrode 27 so as to be slidable in the front and rear direction. Thus, when the sheet cassette 10 is located at the accommodated position, as illustrated in FIG. 6, the first resilient member 15 and the second resilient member 16 are held in reliable contact with the first electrode 26 and the second electrode 27, respectively, and when the sheet cassette 10 is moved from the accommodated position to the separated position, as illustrated in FIG. 10, the first resilient member 15 and the second resilient member 16 are reliably disconnected from the first electrode 26 and the second electrode 27, respectively.

The second electrode 27 is grounded, and the first electrode 26 is pulled up to +5V with respect to the second electrode 27. The first signal output device 94 is a sensor configured to detect the electric potential of the first electrode 26 with respect to the electric potential of the second electrode 27. The first signal output device 94 outputs the conduction signal upon detecting that the electric potential of the first electrode 26 is lower than or equal to +1V. The first signal output device 94 does not output the conduction signal upon detecting that the electric potential of the first electrode 26 is higher than +1V. As illustrated in FIG. 6, when the pressing plate 12 is located at the lowest position, and the raising plate 13 is located at the spaced position, the pressing plate 12 and the raising plate 13 are not in contact with each other, so that the electric potential of the first electrode 26 electrically connected to the pressing plate 12 is kept pulled up to +5V. In this case, the first signal output device 94 detects that the electric potential of the first electrode 26 is higher than +1V and does not output the conduction signal.

Figure 9:
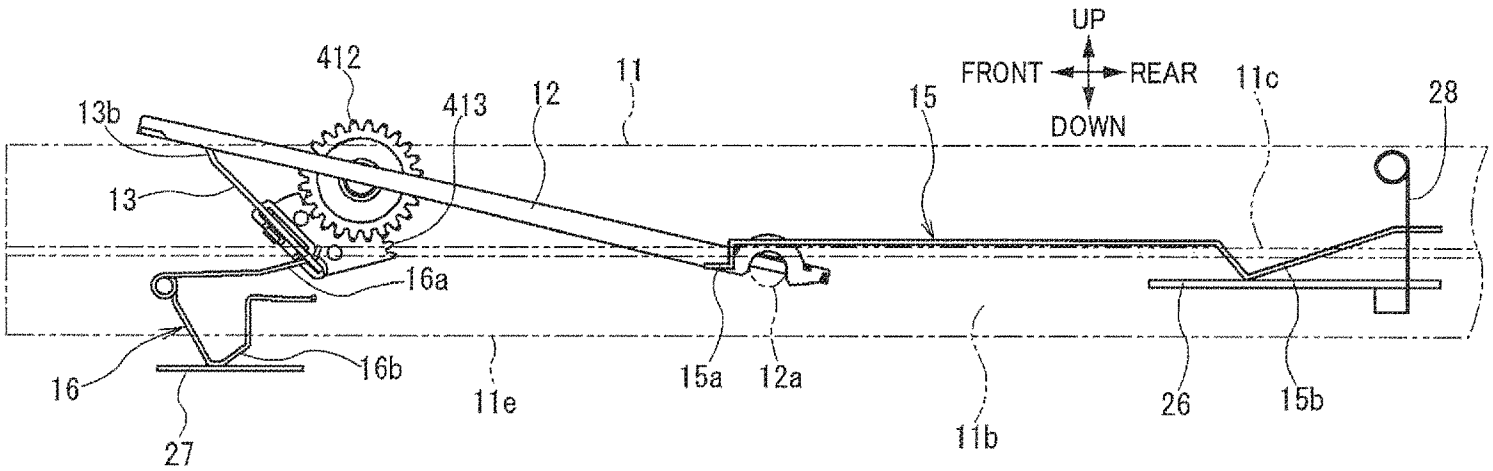
FIG. 9 is a side view of the sheet cassette located at the accommodated position, a raising plate located at a contact position, the first resilient member and the second resilient member provided on the sheet cassette, and the first electrode and the second electrode provided on the sheet-cassette accommodating portion.

As illustrated in FIG. 9, when the raising plate 13 is moved from the spaced position to the contact position, the raising plate 13 and the pressing plate 12 are brought into contact with each other and electrically connected to each other. When the raising plate 13 and the pressing plate 12 are electrically connected to each other, the pressing plate 12 is electrically connected to the second electrode 27 via the raising plate 13 and the second resilient member 16. As a result, the electric potential of the first electrode 26 electrically connected to the pressing plate 12 becomes lower than or equal to +1V. In this case, the first signal output device 94 detects that the electric potential of the first electrode 26 is lower than or equal to +1V and outputs the conduction signal. When the raising plate 13 and the pressing plate 12 are electrically connected to each other, the first electrode 26 connected to the pressing plate 12 and the second electrode 27 connected to the raising plate 13 are also electrically connected to each other, so that the electric potential of the first electrode 26 with respect to the electric potential of the second electrode 27 lowers, and the first signal output device 94 outputs the conduction signal. Accordingly, the first signal output device 94 is configured to output the conduction signal when the first electrode 26 and the second electrode 27 are electrically connected to each other. It is noted that since the point in time when the conduction signal is output by the first signal output device 94 is the point in time when the raising plate 13 is brought into contact with the pressing plate 12, the position of the raising plate 13 at the point in time when the conduction signal is output by the first signal output device 94 is the initial contact position that is a position of the raising plate 13 at the point in time when the raising plate 13 moved from the spaced position contacts and starts raising the pressing plate 12.

It is noted that each of the pressing plate 12 and the raising plate 13 is formed of the conductor of electricity which is formed of a material such as the galvanized sheet iron and the conductive resin in the present embodiment but need not be formed of the conductor entirely. For example, each of the pressing plate 12 and the raising plate 13 is formed of a conductive material and a non-conductive material combined with each other as long as the first electrode 26 and the second electrode 27 are electrically connected to each other when the pressing plate 12 and the raising plate 13 are brought into contact with each other.

In the image forming apparatus 1, a sheet conveying device is constituted by the sheet cassette 10, the body housing 2, the sheet-cassette accommodating portion 2*a*, the first electrode 26, the second electrode 27, the sheet conveyor 20, the driver 4, the first signal output device 94, the second signal output device 95, and the controller 6.

Control for Reducing Calculation Error in Number of Sheets stored in Sheet Cassette In the image forming apparatus 1, the controller 6 is configured to calculate the number of the sheets 18 stored in the sheet cassette 10 (hereinafter may be referred to as the number S of the sheets 18). To reduce an error in calculation of the number S of the sheets 18, the controller 6 executes control described below.

Figure 11:
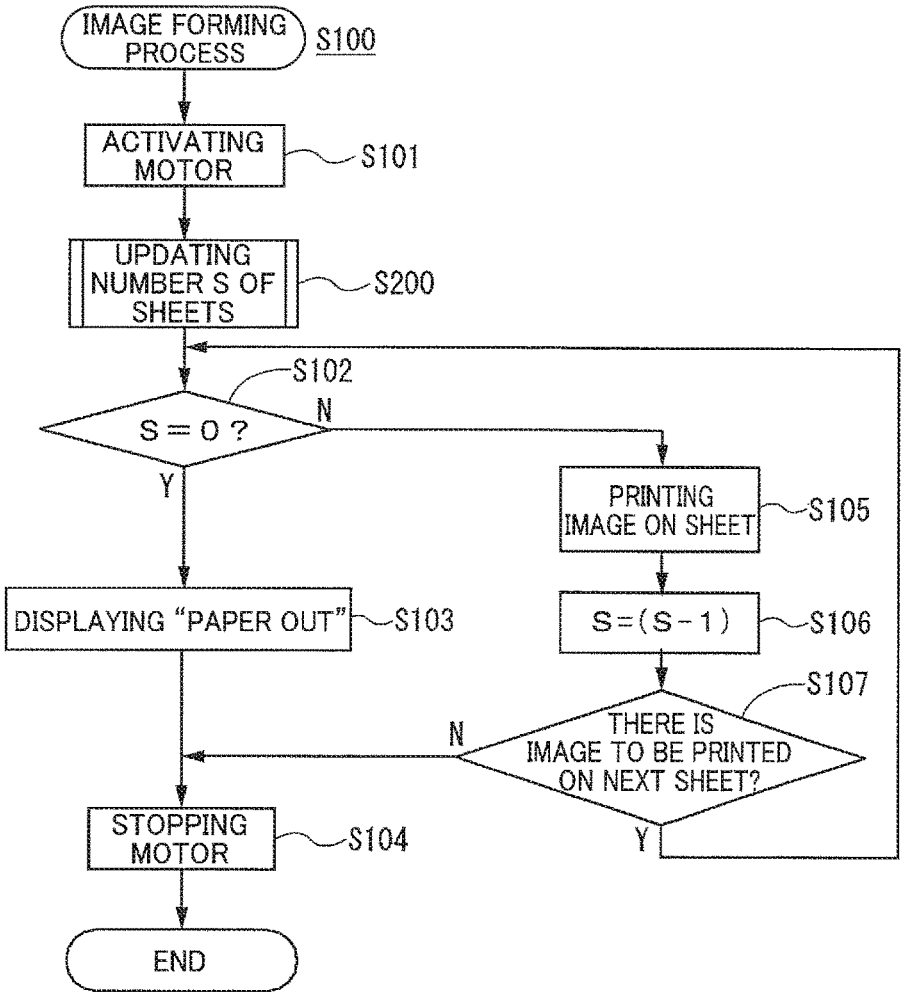
FIG. 11 is a flowchart illustrating an image forming process.

There will be explained an image forming process at S100 at which the image forming unit 5 forms images on the sheets 18. As illustrated in FIG. 11, when the image forming apparatus 1 is instructed to form an image or images, the controller 6 activates the motor 40 at S101. When the motor 40 is activated, the driving force supplied from the motor 40 starts preheating and a preliminary operation of the fixing unit 70, a preliminary operation of the image forming unit 5, and upward pivotal movement of the raising plate 13, for example.

After the motor 40 is activated, the controller 6 at S200 executes a process for updating the number S of the sheets 18 stored in the sheet cassette 10. Upon completion of the process for updating the number S of the sheets 18, the controller 6 at S102 determines whether the number S of the sheets 18 after the update process is zero. When the controller 6 at S102 determines that the number S of the sheets 18 is zero, the controller 6 at S103 controls a display of the image forming apparatus 1 to display information indicating that the image forming apparatus 1 is out of the sheets 18. The controller 6 at S104 stops the motor 40 and terminates the image forming process.

When the controller 6 at S102 determines that the number S of the sheets 18 after the update process is not zero, the controller 6 at S105 controls the image forming unit 5 to print an image on the sheet 18. This printing is performed after the sheets 18 are moved upward to the sheet suppliable position by the pressing plate 12 moved by the raising plate 13 driven by the motor 40.

It is noted that when the sheets 18 are moved upward to the sheet suppliable position, the raising plate 13 and the motor 40 are disconnected from each other to stop the upward movement of the pressing plate 12. In the case where the sheets 18 are located at the sheet suppliable position at the activation of the motor 40, the raising plate 13 and the motor 40 are disconnected from each other without the pressing plate 12 further moved upward.

When the printing on the sheet 18 is finished, the controller 6 at S106 determines the number S of the sheets 18 to a value obtained by subtracting one from the current number S of the sheets 18 (S=S−1). The controller 6 at S107 determines whether there is an image to be printed on the next sheet 18.

When the controller 6 at S107 determines that there is an image to be printed on the next sheet 18, this flow returns to S102 at which the controller 6 determines whether the number S of the sheets 18 is zero. When the number S of the sheets 18 is not zero, the controller 6 at S105 controls the image forming unit 5 to print an image on the sheet 18. When the controller 6 at S107 determines that there is no image to be printed on the next sheet 18, the controller 6 at S104 stops the motor 40 and terminates the image forming process.

Figure 12:
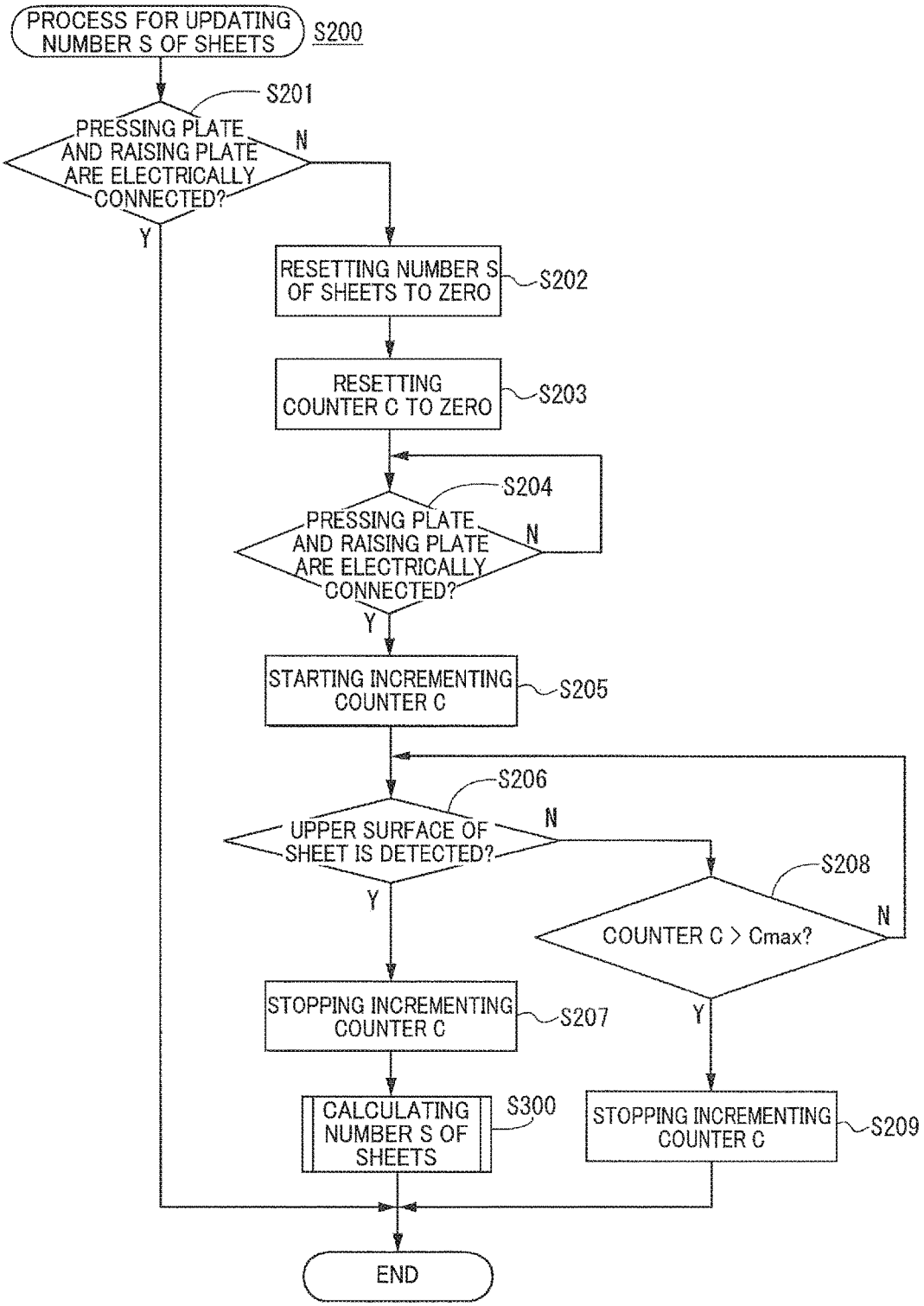
FIG. 12 is a flowchart illustrating a process for updating the number of sheets on the pressing plate.

There will be next explained the process for updating the number S of the sheets 18 (S200). In this process, as illustrated in FIG. 12, the controller 6 at S201 determines whether the pressing plate 12 and the raising plate 13 are electrically connected to each other.

In the image forming apparatus 1, when the sheet cassette 10 is drawn from the accommodated position to the separated position, the pressing plate 12 moves downward to the lowest position, and the raising plate 13 moves downward to the spaced position, so that the pressing plate 12 and the raising plate 13 are spaced from each other. Thus, in the case where the sheet cassette 10 is, for example, drawn from the accommodated position to the separated position and returned to the accommodated position again before the start of the image forming process at S100, the raising plate 13 is located at the spaced position, and the pressing plate 12 and the raising plate 13 are not electrically connected to each other at the point in time when the motor 40 is activated at S101 in the image forming process at S100.

In the case where the sheet cassette 10 is not drawn from the accommodated position to the separated position after the number S of the sheets 18 is calculated in the process for updating the number S of the sheets 18 which is executed before the start of the image forming process at S100, the sheets 18 are kept located at the sheet suppliable position, and the calculated number S of the sheets 18 is held by the controller 6. In this case, the raising plate 13 is located at the contact position, and the pressing plate 12 and the raising plate 13 are electrically connected to each other.

When the controller 6 at S201 determines that the pressing plate 12 and the raising plate 13 are electrically connected to each other, the sheets 18 are kept at the sheet suppliable position, and the calculated number S of the sheets 18 is held by the controller 6. Thus, there is no need to update the number S of the sheets 18. Accordingly, the controller 6 terminates the process at S200 without updating the number S of the sheets 18.

When the controller 6 at S201 determines that the pressing plate 12 and the raising plate 13 are not electrically connected to each other, the raising plate 13 is located at the spaced position, and the pressing plate 12 and the raising plate 13 are not electrically connected to each other. Thus, the controller 6 at S202 resets the number S of the sheets 18 to zero and at S203 resets a value of a counter C to zero. The counter C is provided in the controller 6 to measure the number of rotations of the motor 40.

The controller 6 at S204 determines whether the pressing plate 12 and the raising plate 13 are electrically connected to each other. When the controller 6 determines that the pressing plate 12 and the raising plate 13 are electrically connected to each other, the controller 6 at S205 starts incrementing the counter C to start measuring the number of rotations of the motor 40.

In this case, when the motor 40 is activated at S101 in the image forming process at S100 in the state in which the pressing plate 12 is located at the lowest position, and the raising plate 13 is located at the spaced position, the raising plate 13 is driven by the motor 40 so as to make pivotal movement such that the contact portion 13*b* is moved upward, and the pressing plate 12 and the raising plate 13 are electrically connected to each other when the contact portion 13*b* moved upward is brought into contact with the back surface of the pressing plate 12.

When the pressing plate 12 and the raising plate 13 are brought into contact with each other, the first signal output device 94 detects that the electric potential of the first electrode 26 with respect to the second electrode 27 is lower than or equal to +1V and outputs the conduction signal. Upon receiving the conduction signal output from the first signal output device 94, the controller 6 starts counting the number of rotations of the motor 40 from the point in time when the conduction signal is received. After the pressing plate 12 and the raising plate 13 are electrically connected to each other, the raising plate 13 driven by the motor 40 makes pivotal movement so as to move the contact portion 13*b* upward, thereby moving the pressing plate 12 upward.

That is, in the process for updating the number S of the sheets 18 at S200, the counter C measures the number of rotations of the motor 40 after the raising plate 13 located at the spaced position is driven by the motor 40 and brought into contact with the pressing plate 12. It is noted that the counter C is provided in the controller 6 and configured to count the number of rotations of the motor 40 by incrementing the count value by one each time when the controller 6 receives a pulse signal output from the second signal output device 95. A pulse signal may mean a signal including a pulse, or one of a plurality of pulses in a signal.

After starting measuring the number of rotations of the motor 40, the controller 6 at S206 determines whether an upper surface of an uppermost one of the sheets 18 supported on the pressing plate 12 is detected by the sheet sensor 9. When the controller 6 at S206 determines that the upper surface of the uppermost sheet 18 is detected by the sheet sensor 9, the controller 6 stops incrementing the counter C at S207 and obtains the count value from the start of the incrementing of the counter C to the stop of the incrementing. The controller 6 at S300 uses the obtained count value of the counter C to execute the process for calculating the number S of the sheets 18, thereby calculating the updated number S of the sheets 18. The controller 6 then terminates the process for updating the number S of the sheets 18 at S200.

When the controller 6 at S206 determines that the upper surface of the uppermost sheet 18 is not detected by the sheet sensor 9, the controller 6 at S208 determines whether the count value of the counter C is greater than a value Cmax that is a preset maximum value. A state in which the count value of the counter C is greater than the value Cmax is a state in which the pressing plate 12 supporting no sheets 18 has been moved upward to the position at which the pressing plate 12 is in contact with the pickup roller 21.

When the controller 6 at S208 determines that the count value of the counter C is greater than the value Cmax, the controller 6 at S209 stops incrementing the counter C and terminates the process for updating the number S of the sheets 18 at S200. It is noted that when the controller 6 at S208 determines that the count value of the counter C is greater than the value Cmax, the controller 6 does not update the number S of the sheets 18 and keeps the number S at zero to which the number S is reset at S202.

When the controller 6 at S208 determines that the count value of the counter C is not greater than the value Cmax, this flow returns to S206 at which the controller 6 determines again whether the upper surface of the uppermost sheet 18 is detected by the sheet sensor 9.

In the image forming apparatus 1, as described above, when the sheet cassette 10 is located at the separated position, the pressing plate 12 is located at the lowest position, and the raising plate 13 is located at the spaced position. Accordingly, in the process for updating the number S of the sheets 18 at S200, when the sheet cassette 10 is, for example, drawn from the accommodated position to the separated position and returned to the accommodated position again, the controller 6 reliably calculates the amount of upward movement of the pressing plate 12 based on the number of rotations of the motor 40 after the controller 6 detects that the first electrode 26 and the second electrode 27 are electrically connected to each other by contact of the raising plate 13 with the pressing plate 12.

Also, the first electrode 26 is plate-shaped and disposed on the side portion of the sheet cassette 10, and the second electrode 27 is the frame located below the sheet cassette 10. It is possible to arrange the first electrode 26 and the second electrode 27 without complicating the configuration of the image forming apparatus 1, enabling size reduction of the sheet conveying device without hindrance.

Figure 13:
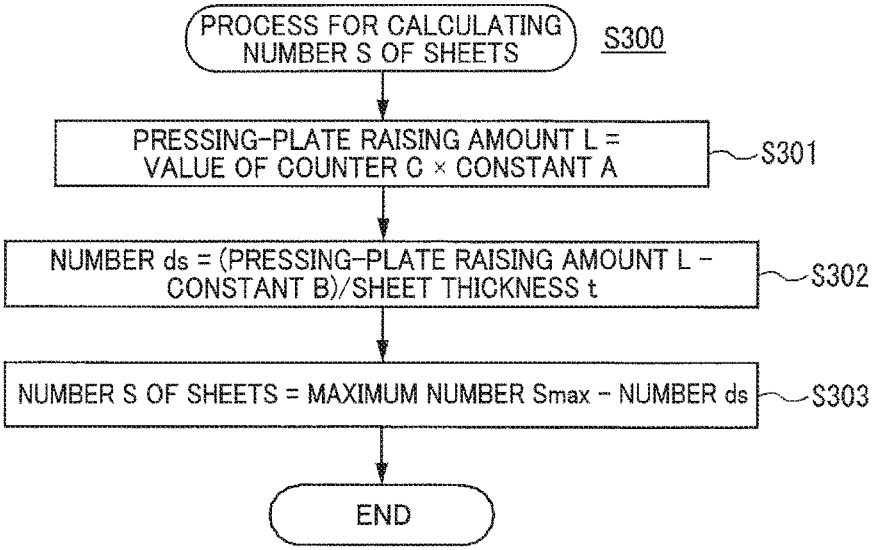
FIG. 13 is a flowchart illustrating a process for calculating the number of sheets on the pressing plate.

There will be next explained the process for calculating the number S of the sheets 18 at S300. In the process for calculating the number S of the sheets 18 at S300, as illustrated in FIG. 13, the controller 6 at S301 calculates an amount L of upward movement of the pressing plate 12 in a period extending from contact of the raising plate 13 with the pressing plate 12, to a point in time when the pressing plate 12 moved upward reaches the position at which the upper surface of the uppermost sheet 18 is detected by the sheet sensor 9. Specifically, the controller 6 calculates the amount L of upward movement by multiplying, by a constant A, the count value of the counter C counted in a period extending from the start of the incrementing (S205) to the stop of the incrementing (S207). In this case, the constant A is a constant of proportionality between the amount L of upward movement of the pressing plate 12 and the count value of the counter C which is proportional to the number of rotations of the motor 40.

The controller 6 at S302 calculates the number ds of the sheets 18 which corresponds to the amount L of upward movement of the pressing plate 12, by dividing, by the thickness t of the sheets 18, a value obtained by subtracting a constant B from the amount L of upward movement of the pressing plate 12. The constant B is an amount of upward movement of the pressing plate 12 in the case where the pressing plate 12 is moved upward from the lowest position to a position at which the sheet sensor 9 detects the upper surface of the uppermost sheet 18 in a state in which the cassette body 11 is full of the sheets 18.

Here, the state in which the cassette body 11 is full of the sheets 18 is a state in which the maximum number Smax of the sheets 18 storable in the cassette body 11 are stored in the cassette body 11. For example, in the case where the cassette body 11 is capable of storing up to 250 sheets 18, a state in which the cassette body 11 stores 250 sheets 18 is the state in which the cassette body 11 is full of the sheets 18. As the thickness t of the sheets 18, a value corresponding to the thickness of the sheet 18 stored in the cassette body 11 is set in advance in the controller 6.

The controller 6 at S303 calculates the number S of the sheets 18 stored in the cassette body 11 by subtracting the number ds from the maximum number Smax of the sheets 18.

In the sheet conveying device of the image forming apparatus 1 described above, when calculating the amount of upward movement of the pressing plate 12 based on the number of the pulse signals output from the second signal output device 95, the controller 6 starts counting the number of the pulse signals received from the second signal output device 95, from the point in time when the conduction signal output from the first signal output device 94 is received. Thus, the number of rotations of the motor 40 which is measured by the counter C does not include the number of rotations of the motor 40 in a period extending from the point in time when the motor 40 starts driving the raising plate 13 to the point in time when the raising plate 13 is brought into contact with the pressing plate 12.

This configuration removes, from the measured value of the counter C, variations of the number of rotations of the motor 40 in a period extending from the point in time when the motor 40 starts driving the raising plate 13 to the point in time when the pressing plate 12 starts upward movement caused by the raising plate 13 contacting the pressing plate 12. Accordingly, it is possible to sufficiently reduce the error in calculation of the number S of the sheets 18 when calculating the number S of the sheets 18 on the pressing plate 12 based on the amount L of upward movement of the pressing plate 12.

Effects

In the present embodiment, as described above, the sheet conveying device of the image forming apparatus 1 includes: the sheet cassette 10 having the pressing plate 12, the raising plate 13, the first resilient member 15, and the second resilient member 16; the body housing 2; the sheet-cassette accommodating portion 2*a*; the first electrode 26; the second electrode 27; the sheet conveyor 20; the driver 4; the first signal output device 94; the second signal output device 95; and the controller 6. Also, the controller 6 is capable of receiving the conduction signal output from the first signal output device 94 and the pulse signal output from the second signal output device 95. Also, when the controller 6 moves the raising plate 13 to move the pressing plate 12 upward by controlling the driver 4, the controller 6 starts counting the number of the pulse signals received from the second signal output device 95, from the point in time when the conduction signal output from the first signal output device 94 is received, and the controller 6 calculates the amount of upward movement of the pressing plate 12 based on the number of the pulse signals.

This configuration removes, from the measured value of the pulse signal, the variations of the number of rotations of the motor 40 in the period extending from the point in time when the motor 40 starts driving the raising plate 13 to the point in time when the pressing plate 12 starts upward movement caused by the raising plate 13 contacting the pressing plate 12. Accordingly, it is possible to sufficiently reduce the error in calculation of the number S of the sheets 18 when calculating the number S of the sheets 18 on the pressing plate 12 based on the amount L of upward movement of the pressing plate 12.

The sheet cassette 10 is movable between the accommodated position at which the sheet cassette 10 is accommodated in the body housing 2 and the separated position at which the sheet cassette 10 is separated from the body housing 2. When the sheet cassette 10 is located at the separated position, the pressing plate 12 is located at the lowest position, and the raising plate 13 is located at the spaced position.

With this configuration, when the sheet cassette 10 is, for example, drawn from the accommodated position to the separated position and returned to the accommodated position again, the controller 6 reliably calculates the amount L of upward movement of the pressing plate 12 based on the number of rotations of the motor 40 after the controller 6 detects that the first electrode 26 and the second electrode 27 are electrically connected to each other by contact of the raising plate 13 with the pressing plate 12. It is noted that the following configuration may be employed for a configuration for detecting that the raising plate 13 is brought into contact with the pressing plate 12. For example, a torque sensor is provided on a rotation shaft of the motor 40, and the motor 40 is driven to move the raising plate 13 toward the pressing plate 12 while the torque sensor is detecting rotation torque of the rotation shaft of the motor 40 in a state in which the raising plate 13 is not in contact with the pressing plate 12. The rotation shaft of the motor 40 receives a reaction force from the raising plate 13 when the raising plate 13 is brought into contact with the pressing plate 12. Thus, a value detected by the torque sensor suddenly increases when the raising plate 13 starts contacting the pressing plate 12. The controller 6 may detect that the raising plate 13 is brought into contact with the pressing plate 12, by detecting the sudden change of the value detected by the torque sensor. In another configuration, it is considered that a rotational-speed sensor configured to detect a rotational speed of the motor 40 and a current sensor configured to detect a value of the current flowing through a coil of the motor 40 are provided on the motor 40, for example. In this configuration, the controller 6 controls the value of the current flowing through the coil to make the rotational speed of the motor 40 constant, while detecting the value detected by the rotational-speed sensor provided on the motor 40 in the state in which the raising plate 13 is not in contact with the pressing plate 12. In this control, the raising plate 13 is moved from the distant position toward the pressing plate 12. When the raising plate 13 is thereafter brought into contact with the pressing plate 12, the value of the current flowing through the coil is increased to make the rotational speed of the motor 40 constant. The contact of the raising plate 13 with the pressing plate 12 may be detected by the sudden change of the value of the current.

When the sheet cassette 10 is located at the accommodated position, the second portion 15*b* of the first resilient member 15 is in contact with the first electrode 26 so as to be slidable in the direction of the movement of the sheet cassette 10, and the second portion 16*b* of the second resilient member 16 is in contact with the second electrode 27 so as to be slidable in the direction of the movement of the sheet cassette 10.

With this configuration, when the sheet cassette 10 is located at the accommodated position, the first resilient member 15 and the second resilient member 16 are held in reliable contact with the first electrode 26 and the second electrode 27, respectively, and when the sheet cassette 10 is moved from the accommodated position to the separated position, the first resilient member 15 and the second resilient member 16 are reliably disconnected from the first electrode 26 and the second electrode 27, respectively.

The first electrode 26 is plate-shaped and disposed on the side portion of the sheet cassette 10. The second electrode 27 is the frame located below the sheet cassette 10.

This configuration makes it possible to arrange the first electrode 26 and the second electrode 27 without complicating the configuration of the image forming apparatus 1, enabling size reduction of the sheet conveying device without hindrance.

While the disclosure has been described in detail with reference to the specific embodiment, various changes, arrangements and modifications may be applied therein without departing from the spirit and scope of the disclosure.

What is claimed is:

1. A sheet conveying device, comprising:

a sheet cassette including:

(i) a first housing configured to accommodate sheets;

(ii) a pressing plate formed of a conductive material, provided at the first housing, and movable upward and downward while supporting the sheets;

(iii) a raising plate formed of a conductive material, provided at the first housing, and movable from a spaced position at which the raising plate is spaced from the pressing plate to and beyond an initial contact position at which the raising plate contacts the pressing plate and starts moving the pressing plate upward;

(iv) a first resilient member formed of a conductive material and provided at the first housing, the first resilient member including a first end portion in contact with the pressing plate, and a second end portion; and (v) a second resilient member formed of a conductive material and provided at the first housing, the second resilient member including a first end portion in contact with the raising plate, and a second end portion;

a second housing;

a sheet-cassette accommodating portion provided at the second housing and accommodating the sheet cassette;

a first electrode provided at the sheet-cassette accommodating portion and in contact with the second end portion of the first resilient member;

a second electrode provided at the sheet-cassette accommodating portion and in contact with the second end portion of the second resilient member;

a sheet conveyor provided at the second housing and configured to convey a sheet from the pressing plate;

a driver provided at the second housing and configured to move the raising plate, the driver including:

(a) a motor configured to supply a driving force; and (b) a transmission mechanism configured to transmit to the raising plate the driving force supplied from the motor;

a first signal output device configured to output a conduction signal when the first electrode and the second electrode are electrically connected to each other;

a second signal output device configured to output pulse signals indicating an amount of rotation of the motor; and a controller configured to, when controlling the driver to move the raising plate to move the pressing plate upward:

detect a state change in the first signal output device from not outputting the conduction signal to outputting the conduction signal, the state change corresponding to a positional change of the raising plate from the spaced position to the initial contact position;

upon detection of the state change in the first signal output device, start counting a number of pulse signals received from the second signal output device; and determine an amount of upward movement of the pressing plate based on the counted number of pulse signals.

2. The sheet conveying device according to claim 1, wherein the sheet cassette is movable between an accommodated position at which the sheet cassette is accommodated in the second housing and a separated position at which the sheet cassette is separated from the second housing, and wherein when the sheet cassette is located at the separated position:

the first electrode is spaced from the second end portion of the first resilient member, and the second electrode is spaced from the second end portion of the second resilient member;

the transmission mechanism is unable to transmit to the raising plate the driving force supplied from the motor; and the pressing plate is located at a lowest position thereof, and the raising plate is located at the spaced position.

3. The sheet conveying device according to claim 2, wherein the second end portion of the first resilient member is configured to contact the first electrode slidably in a direction of movement of the sheet cassette, and wherein the second end portion of the second resilient member is configured to contact the second electrode slidably in the direction of movement of the sheet cassette.

4. The sheet conveying device according to claim 1, further comprising a sheet sensor configured to detect an uppermost one of the sheets on the pressing plate moved upward by the raising plate when the controller controls the driver to move the raising plate from the spaced position, via the initial contact position, to a predetermined position.

5. The sheet conveying device according to claim 4, wherein the raising plate is configured to keep in contact with the pressing plate during movement of the raising plate from the initial contact position to the predetermined position.

6. The sheet conveying device according to claim 4, wherein the controller is configured to determine the amount of upward movement of the pressing plate based on the number of pulse signals received from the second signal output device during a period from when the controller detects the state change in the first signal output device till when the sheet sensor detects the uppermost one of the sheets on the pressing plate.

7. The sheet conveying device according to claim 1, wherein the controller is configured to determine a number of sheets on the pressing plate based on the counted number of pulse signals.

8. The sheet conveying device according to claim 1, wherein the first electrode is plate-shaped and provided on a side portion of the sheet cassette, and wherein the second electrode is a frame disposed under the sheet cassette.

9. An image forming apparatus comprising:

a sheet conveying device including:

a sheet cassette including:

(i) a first housing configured to accommodate sheets;

(ii) a pressing plate formed of a conductive material, provided at the first housing, and movable upward and downward while supporting the sheets;

(iii) a raising plate formed of a conductive material, provided at the first housing, and movable from a spaced position at which the raising plate is spaced from the pressing plate to and beyond an initial contact position at which the raising plate contacts the pressing plate and starts moving the pressing plate upward;

(iv) a first resilient member formed of a conductive material and provided at the first housing, the first resilient member including a first end portion in contact with the pressing plate, and a second end portion; and (v) a second resilient member formed of a conductive material and provided at the first housing, the second resilient member including a first end portion in contact with the raising plate, and a second end portion;

a second housing;

a sheet-cassette accommodating portion provided at the second housing and accommodating the sheet cassette;

a first electrode provided at the sheet-cassette accommodating portion and in contact with the second end portion of the first resilient member;

a second electrode provided at the sheet-cassette accommodating portion and in contact with the second end portion of the second resilient member;

a sheet conveyor provided at the second housing and configured to convey a sheet from the pressing plate;

a driver provided at the second housing and configured to move the raising plate, the driver including:

(a) a motor configured to supply a driving force; and (b) a transmission mechanism configured to transmit to the raising plate the driving force supplied from the motor;

a first signal output device configured to output a conduction signal when the first electrode and the second electrode are electrically connected to each other;

a second signal output device configured to output pulse signals indicating an amount of rotation of the motor; and a controller configured to, when controlling the driver to move the raising plate to move the pressing plate upward:

detect a state change in the first signal output device from not outputting the conduction signal to outputting the conduction signal, the state change corresponding to a positional change of the raising plate from the spaced position to the initial contact position;

upon detection of the state change in the first signal output device, start counting a number of pulse signals received from the second signal output device; and determine an amount of upward movement of the pressing plate based on the counted number of pulse signals; and an image former provided in the second housing and configured to form an image on the sheet conveyed from the sheet conveying device by the sheet conveyor.

* * * * *